US005779516A

United States Patent [19]

Thorne

[11] Patent Number: 5,779,516

[45] Date of Patent: Jul. 14, 1998

[54] CUSTOMIZED SHEET MATERIAL FIGURE WITH PORTRAIT-STYLE FACIAL LIKENESS

[75] Inventor: Elizabeth Troxler Thorne, Raleigh, N.C.

[73] Assignee: Portrait Pals, Inc., Raleigh, N.C.

[21] Appl. No.: 538,078

[22] Filed: Oct. 2, 1995

Related U.S. Application Data

[63] Continuation of Ser. No. 245,653, May 18, 1994, abandoned.

[51] Int. Cl.[6] ..... A63H 3/08

[52] U.S. Cl. ..... 446/98; 446/391; 434/81

[58] Field of Search ..... 446/98, 387, 391, 446/385; 434/81

[56] References Cited

U.S. PATENT DOCUMENTS

| | | | |
|---|---|---|---|
| 2,170,971 | 8/1939 | Lodewick et al. | 446/391 X |
| 2,369,031 | 2/1945 | Engle | 446/387 |
| 3,316,669 | 5/1967 | Nachbar | 40/142 |
| 4,294,634 | 10/1981 | Mookil | 156/59 |
| 4,659,319 | 4/1987 | Blair | 446/87 |
| 4,929,213 | 5/1990 | Morgan | 446/97 |
| 4,993,987 | 2/1991 | Hull et al. | 446/391 X |
| 5,009,626 | 4/1991 | Katz | 446/391 |
| 5,314,370 | 5/1994 | Flint | 446/391 |

FOREIGN PATENT DOCUMENTS

0418730 A1 3/1991 European Pat. Off. .

OTHER PUBLICATIONS

Paper Mate, *Traditional Home* (Magazine), 1–page ad (Nov. 1993).

*Primary Examiner*—Mickey Yu

*Attorney, Agent, or Firm*—Bell Seltzer Intellectual Property Law Group of Alston & Bird, LLp

[57] ABSTRACT

A customized paper doll is disclosed. The doll comprises a head portion and a body portion; the head portion comprises a reduced-size replica of a portrait bearing the facial likeness of a person recognizable to the child who is to play with the doll. A method for producing the customized doll is also enclosed.

19 Claims, 2 Drawing Sheets

CUSTOMIZED SHEET MATERIAL FIGURE WITH PORTRAIT-STYLE FACIAL LIKENESS

This application is a continuation of application Ser. No. 08/245,653, filed 18 May 1994, abandoned.

FIELD OF THE INVENTION

This invention relates generally to recreational devices, and relates more specifically to paper dolls and the like.

BACKGROUND OF THE INVENTION

Paper dolls have been made and enjoyed by children for many years. Rudimentary paper dolls can be made by a child at home. Typically a child cuts a paper doll from paper or other sheet material, which often contain preprinted indicia of the desired shape, creates a facial image on the doll by drawing, pasting, painting, or some other method, and makes clothing and other ornamentation that can be attached to the doll for play.

There have been attempts to provide customized paper dolls, i.e., dolls having the face and/or body of a person recognizable to the child who is to play with the doll, such as the child herself, a family member, or a best friend. These dolls are particularly popular with children, who often greatly enjoy the opportunity to play with a doll having a familiar facial image. U.S. Pat. No. 2,369,031 to Engle discusses a customized paper doll which utilizes a photographic image of the recognizable person in conjunction with a standard body image. A photographic negative of the facial image is projected onto and thereby imprinted on a sensitized paper. The facial image is then attached to an adhesive backing sheet that includes the standard body image. The primary shortcoming of this method and doll is in the finished product. The color of the standardized body rarely matches with that of the photographic head; the result is a doll with a somewhat disjointed appearance.

Another customized doll is discussed in U.S. Pat. No. 4,993,987 to Hull et al. The method disclosed therein employs a matrix scanner to scan a photograph for red, yellow, and blue color components. The information gathered in the scan is used to create electronic stencils for each of these colors. A paper sheet is then colored in three printing steps, one for each color. The printed paper is then heat pressed into a material, such as a fabric, at approximately 400 degrees Fahrenheit; this step impregnates the material with the photographic image of the recognizable person. Although this method can produce a doll that is less disjointed in appearance than that of Engle, it requires a photograph of the entire body to do so; if only a photographic head is provided, the appearance remains disjointed. In addition, the process is relatively expensive.

In addition to the difficulty of matching a head to a body so that the doll does not appear disjointed, the dolls of the prior art are limited to photographic reproductions of the person whose likeness is borne by the doll. An exact reproduction of the person's face projects the precise facial expression, hair style, and facial features of that person. Particularly when the face is that of a child, the exactness of a photographic reproduction can be undesirable, as children are often uncooperative when being asked to sit for a photograph and thus can take unflattering photographs. Also, the facial features of children can change rapidly, which may make a doll having the facial features of the child at a younger age unattractive to the child, who may feel that the doll depicts her as a "baby". Further, the precise nature of a photograph may limit child's creativity when playing with the doll and can thus inhibit fantasy-based play.

In view of the foregoing, it is an object of the present invention to provide a method for producing a customized doll-type figure for which the head and body portions are closely matched in appearance.

It is also an object of the present invention to provide a method for producing a customized doll-type figure at a relatively low cost.

It is a further object of the present invention to provide a customized doll-type figure that is styled to be appealing to the child that is to play with it.

SUMMARY OF THE INVENTION

These objects and others are satisfied by the present invention, which as a first aspect includes a method of producing a customized paper doll having the facial likeness of a person recognizable to a child playing with the doll, which can be the likeness of the child herself. A portrait is provided bearing the facial likeness of the recognizable person. The portrait is replicated in a reduced size to form a head portion of the doll. The head portion is combined with a sheet material bearing the likeness of a body portion to form the customized doll having a portrait-style facial likeness. Preferably, the body portion is selected from a group of body portion likeness of different proportions representing different ages and genders of persons. After selecting a body portion, the color of the transition region at the junction between the head portion and the body portion may be adjusted to reduce the visual effect of any color mismatch between the head and body portions. The resulting doll has a portrait-style facial-likeness customized for a specific child.

DETAILED DESCRIPTION OF THE INVENTION

The present invention will now be described hereinbelow with reference to the accompanying drawings. The invention is not intended to be limited to the embodiment described herein; rather, the illustrated embodiment is intended to provide those skilled in this art with a complete understanding of the invention.

Figure 1:
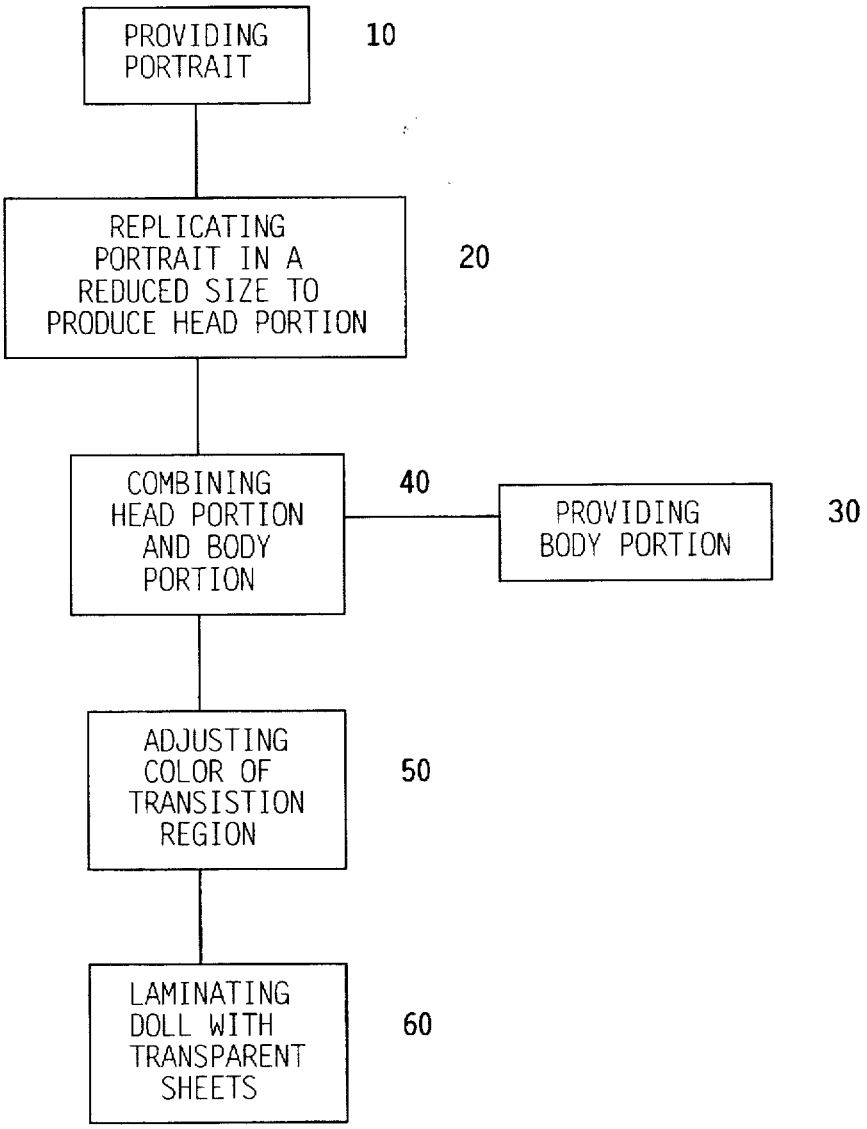
FIG. 1 is a flow diagram representing a method of producing a customized doll in which a reduced-size replica of the portrait having the facial likeness of a recognizable person.

Referring now to the drawings, FIG. 1 shows the steps of a method of the present invention in which a customized doll is produced. Initially, a portrait bearing the facial likeness of a person recognizable to a child playing with the doll, such as the child herself, a family member, or a close friend, is provided (box 10 in FIG. 1). As used herein, the term "portrait" is intended to mean a substantially two-dimensional stylized facial likeness of a person created by an artist by drawing, painting, or some other technique of original production. Suitable portraits include: those produced by classical portraiture, including realist, naturalist, and impressionist portraits, and portraits produced by techniques such as imprimatura; caricatures; renderings; and character studies. It is preferred that the classical portrait style be used. It is not intended that the term include still photographs or images obtained from motion picture film, videotape, or other exact reproductions of a facial image.

However, a portrait painted over a photograph (the product of a technique used by some photographers) is intended to be encompassed by the present invention, as are portraits for which general facial proportions have been outlined from a magnified photograph. Also, portraits produced via computer graphics software such as PHOTOSOFT (available from Adobe Systems, Inc., Mountain View, Calif.) are also intended to be encompassed by the present invention.

Exemplary media suitable for producing a portrait for use with the present invention include paints such as watercolors, pastels, and acrylics, and drawing media such as chalks and inks, with pastels, watercolors, and acrylics being the preferred media. The portrait is preferably provided in color, although portraits produced in monochromatic media, such as charcoal and black inks, and tonal drawings are also suitable. The portrait can be produced by observation of a live model, a photograph, or from the artist's memory, or a combination of any or all of these.

After the portrait is produced, it is replicated on a sheet material in a reduced size to form a head portion of the customized doll (box 20 of FIG. 1). As used herein, replicating the portrait in a reduced size means reproducing the exact features of the portrait in their relative proportions, but doing so in such a manner that the head portion is a reduced-size replica of the portrait. The replicating step can be carried out by virtually any technique that produces a reduced-size replica of the portrait. Exemplary replicating processes include xerographically replicating the portrait, creating a photographic slide of the portrait and producing a reduced size replica therefrom, and scanning the portrait with a laser scanner and digitally reproducing a reduced-size replica of the portrait. The preferred method uses commerically available color xerography equipment.

Depending on its size and the capability of the replicating apparatus, the portrait may be replicated a single time, or may require two or more replications in order to be reduced to a size that is appropriate for a doll. Typically, the portrait is drawn or painted at least large enough to fill a 4 inch by 5 inch sheet; at this size, generally at least two reductions are required to reduce the portrait to a size appropriate for a doll. The portrait is replicated onto a sheet material, such as paper, cardboard, fabric, or the like, to form the head portion.

A sheet material is provided that bears the likeness of a body portion (box 30 of FIG. 1). Preferably, the body portion is produced in the same medium as the head portion, as doing so can improve the appearance of the doll, and in particular can improve the appearance of the transition region where the head and body portions are joined by reducing the effect of any color, tone, or style mismatch of the head and body portions. The body portion should be produced so that it has proportions generally corresponding to the size, age and gender of the person whose facial likeness appears on the head portion.

Because the likenesses of human bodies, and in particular children's bodies, are somewhat similar for humans of the same age and gender, it is preferred to "preproduce" a group of body portions, each of which has different proportions from the other members of the group and represents a body differing from the other group members in age, gender, or both. A body portion that has proportions generally corresponding to the age and gender of the person whose facial likeness appears on the head portion is then selected from this group for inclusion with a particular doll. Multiple copies of each body portion representing a different age and gender combination can be preproduced and thus provided for combination with a head portion.

The body portion is combined with the head portion to form a customized doll (box 40 of FIG. 11). The combining step can be carried out by adhering or otherwise attaching the head portion to the body portion, then reproducing the attached head and body portion to form a single integrated unit. The adhering medium, should be applied to the rear (i.e., non-decorated) sides of the head and body portions in order to preserve the doll's appearance. Reproduction of the attached head and body portions can be carried out by any of the methods described above for replicating the head portion, such as xerographically reproducing the attached elements.

The combining step can be carried out after the portrait has been completely reduced to an appropriate size for a doll (typically the entire doll will be between about 6 and 12 inches, and preferably between about 8 and 10 inches, in height). If the head portion is completely reduced in size prior to combination with a body portion, preferably the head portion-body portion combination is reproduced an additional time in order that the final product be free of any seam at the junction between the head portion and the body portion. Alternatively, the head portion may be combined with the body portion after the head portion has been reducibly replicated at least once but prior to a final size reduction necessary to produce an appropriately-sized doll. If this is the sequence of steps to be followed, the body portion can be produced directly on the sheet material that contains the reduced head portion. This can be done if the portrait is reducibly replicated onto a location on a sheet material, such as an edge portion of the sheet, so that sufficient area remains on the sheet material to create the body portion in proper proportion to the head portion. Preferably, when this sequence of steps is followed, the body portion is produced with a stencil or some other drawing aid that increases the speed and accuracy with which the body portion can be produced. After the body portion is completed, the head and body portion combination is then further reducibly replicated to an appropriate size for a paper doll. This procedure can be advantageous in that it can reduce the number of reproduction generations the head portion is subjected to, which in turn can increase the quality of the facial likeness of the head portion.

After the head portion and body portion have been combined, and particularly after the head portion has been combined with a preproduced body portion, it is often beneficial to adjust the appearance of the transition region located adjacent the junction between the head portion and the body portion (box 50 of FIG. 1). Adjusting, or "touching-up", the transition region can reduce the visual effect of any mismatch, and in particular any color mismatch, between the head and body portions, a condition to which the dolls are particularly susceptible when a preproduced body portion is used. Preferably, the appearance is adjusted using the same medium as was used to create the facial likeness and the body portion of the doll.

After the appearance of the transition region has been adjusted, the durability of the doll can be improved by laminating the doll with at least one, and preferably two, clear transparent sheets (box 60 of FIG. 1). Laminating the doll can increase the strength, stiffness and tear resistance of the doll without detracting from its appearance. The transparent sheet can be any sheet known to those skilled in this art to be suitable for transparently protecting a sheet material, including self-adhering sheets and heat-formable sheets. An exemplary transparent sheet material is provided by Professional Binding Products, Inc. (Agoura Hills, Calif.).

Figure 2:
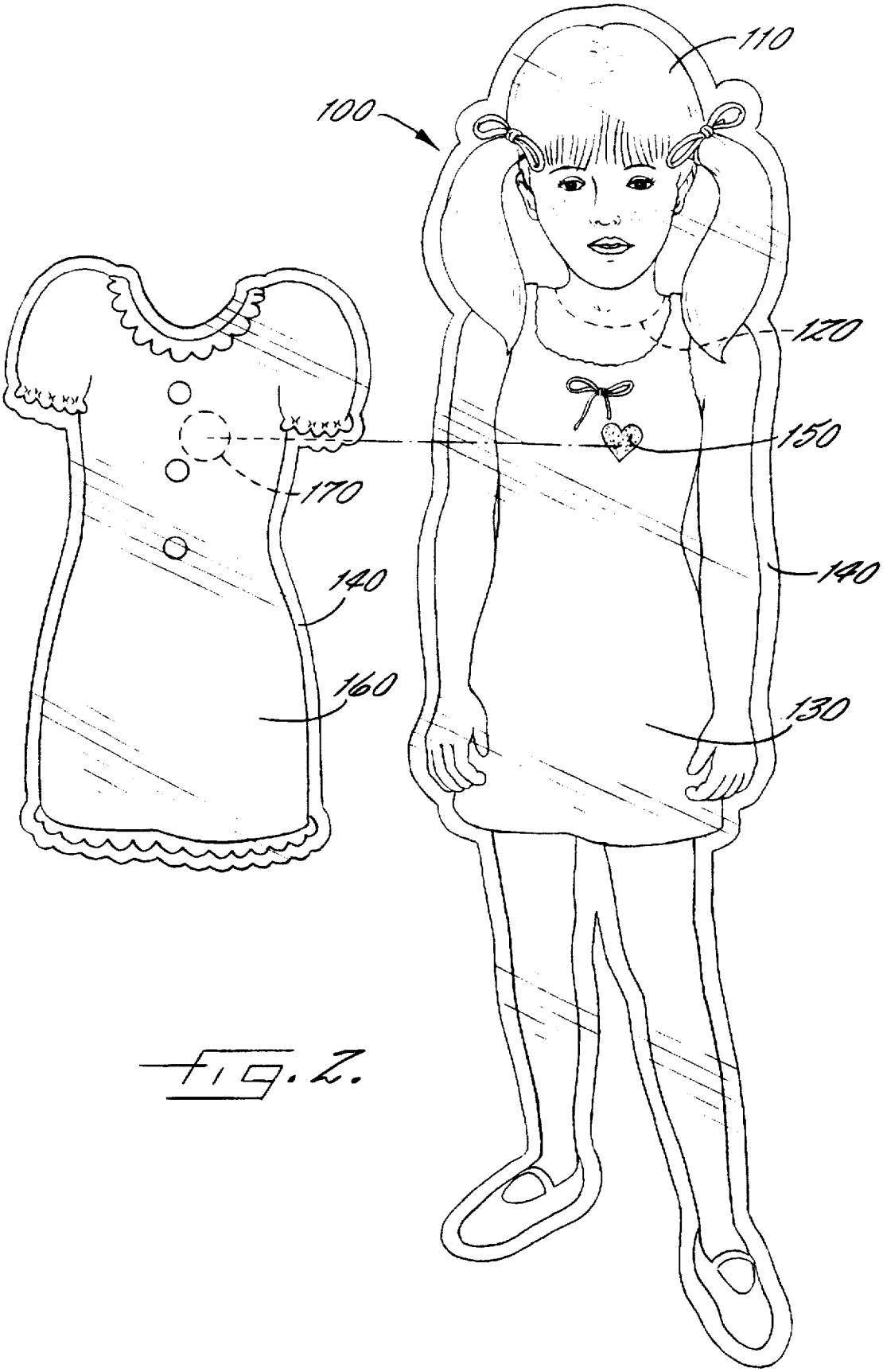
FIG. 2 is plan view of a finished customized doll showing how a simulated clothing outfit can be attached.

A customized doll, designated broadly at 100, produced by the above described method is illustrated in FIG. 2. The doll 100 comprises a head portion 110 attached through a transition region 120 to a body portion 130. The doll 100 is protected by clear laminate 140. As stated above, the head portion 110 comprises a reduced-size replica of a portrait bearing the facial likeness of a person recognizable to the child to be playing with the doll. The portrait-style head portion 110 is desirable in that it provides great flexibility to the artist creating the portrait; the artist is not bound to the precise facial structure of the person whose likeness appears on the doll. As a result, the person's appearance can be adjusted to increase or decrease age, eliminate or de-emphasize undesirable features such as facial blemishes or scars, experiment with and adjust coloration, and accentuate attractive features; these adjustments to the facial likeness, which are commonly made in non-photographic portraits, can be made much more easily than could be done if a photographic likeness was used for the head portion. Also, because it is often desirable to employ a preproduced body portion, the color of the head portion can be more easily matched to that of the body portion than would be the case for a photographic head and body portion. Finally, the portrait style of the head portion may lend itself to the fantasy-based play of child because the head portion itself is not an exact reproduction of the person.

To permit the attachment of simulated clothing outfits for the doll, a tab formed of Velcro® hook and loop fastener tab (150 in FIG. 2) is attached to the front surface of the doll 110. The tab 150 mates with a hook and loop fastener tab 170 that is attached to the rear, or undecorated, surface of an outfit 160, which includes indicia 165 on its front surface that represent one or more articles of clothing for the doll. Although the illustrated tabs 150, 170 are preferred, those skilled in this art will appreciate that any means for releasably securing sheet material comprising simulated clothing 160 to the doll 100 is suitable for use with this invention. Exemplary alternative securing means include foldable tabs located on the outfit, a layer of releasable adhesive on the back surface of the doll, and the like.

The foregoing embodiments are illustrative of the present invention, and are not to be construed as limiting thereof. The invention is defined by the following claims, with equivalents of the claims to be included therein.

That which is claimed is:

1. A method of producing a customized doll formed from a sheet material and having the facial likeness of a person recognizable to a child playing with the doll, said method comprising the steps of:

providing a painted portrait bearing the facial likeness of a person, said portrait being of a size at least sufficient to substantially cover a 4 inch by 5 inch sheet;

providing a sheet material bearing the likeness of a body portion;

replicating said portrait on a sheet material in a reduced size to form a head portion of a size that is proportionate in scale to said body portion; and combining said head portion and said body portion to form a customized doll having the facial likeness of said person and being between 6 and 12 inches in height.

2. The method defined in claim 1, wherein said step of preparing a portrait comprises producing said portrait in color in a medium selected from the group consisting of pastels, watercolors, and acrylics.

3. The method defined in claim 1, wherein said step of providing a sheet material bearing the likeness of a body portion comprises providing a likeness of a body portion having proportions generally corresponding to the size and age of the person whose facial likeness appears on said head portion.

4. The method defined in claim 1, wherein said step of providing a sheet material bearing the likeness of a body portion comprises providing sheet materials bearing a set of body portion likenesses of different proportions representing different ages and genders of persons, and selecting from said set a body portion likeness having proportions generally corresponding to the size, age and gender of the person whose facial likeness appears on said head portion.

5. The method defined in claim 1, further comprising the step of adjusting the appearance of a transition region between the head portion and body portion to reduce the visual effect of any mismatch between the head and body portions.

6. The method defined in claim 1, further comprising the step of laminating at least one transparent sheet onto the figure following said combining step.

7. The method defined in claim 1, wherein said replicating step comprises xerographically reducing said facial likeness to produce said head portion.

8. The method defined in claim 1, further comprising the step of replicating said head portion and said body portion following said combining step.

9. The method defined in claim 8, wherein said step of replicating said head portion and said body portion comprises replicating said head and body portions in a reduced size.

10. A method of producing a customized doll formed from a sheet material and having the facial likeness of a person recognizable to a child playing with the doll, said method comprising the steps of:

producing in a medium selected from the group consisting of pastels, watercolors and acrylics, a color portrait bearing a two-dimensional stylized facial likeness of a person, said portrait being of a size at least sufficient to substantially cover a 4 inch by 5 inch sheet;

xerographically replicating said portrait in color in a reduced size on a sheet material to form a reduced size color head portion;

providing a sheet material bearing the representation of a body portion at a scale corresponding to the scale of said reduced size head portion, said representation being produced in the same medium used for said color portrait; and combining said head portion and said body portion to form a customized doll having the facial likeness of said person and being between about 6 and 12 inches in height.

11. A customized figure formed of a sheet material and having the likeness of a person recognizable to a child playing with the figure, said figure comprising:

a sheet material bearing the representation of a human body having a head portion and a body portion;

said head portion comprising a reduced-size replica of a portrait bearing the facial likeness of a person, said portrait being of a sufficient size to at least substantially cover a 4 inch by 5 inch sheet and said head portion being of a size to be proportionate in scale to said body portion; and said body portion bearing the likeness of a human body, said figure being between about 6 and 12 inches in height.

12. The figure defined in claim 11, further comprising a transition region between said head and body portions, said transition region reducing the visual effect of any mismatch between said head and body portions.

13. The figure defined in claim 11, further comprising at least one transparent sheet laminated onto said figure.

14. The figure defined in claim 11, wherein the head portion comprises a reduced-size replica of a portrait produced in a medium selected from the group consisting of pastels, watercolors, and acrylics.

15. The figure defined in claim 11 wherein said body portion comprises a reduced-size replica of a body portion sized to match proportionately with the portrait from which said head portion is produced.

16. The figure defined in claim 11, wherein said head portion comprises a xerographically reduced-size replica of a portrait.

17. The figure defined in claim 11, wherein said body portion has proportions generally corresponding to the size and age of the person whose facial likeness appears on said head portion.

18. The figure defined in claim 11, further comprising means for releasably securing sheet material containing therein indicia representing clothing for said figure, said securing means being attached to said body portion.

19. A customized figure formed of a sheet material and having the likeness of a person recognizable to a child playing with the figure, said figure comprising:

a sheet material bearing the representation of a human body having a head portion and a body portion;

said head portion comprising a reduced-size color replica of a color portrait produced in a medium selected from the group consisting of pastels, watercolors and acrylics, and bearing a two-dimensional stylized facial likeness of a recognizable person, and being of a sufficient size to at least substantially cover a 4 inch by 5 inch sheet, and said head portion being of a size to be proportionate in scale to said body portion;

said body portion bearing the representation of a human body portion at a scale corresponding to the scale of said reduced size head portion, said representation being produced in the same medium used for said color portrait; and a transition region between said head portion and said body portion where said the reduced-size color replica head portion is joined to said body portion;

said figure being between 6 and 12 inches in height.

* * * * *